United States Patent [19]

Edgerton, Jr. et al.

[11] 3,998,304

[45] Dec. 21, 1976

[54] WATERPROOF CONTAINER FOR GOODS

[75] Inventors: C. Willis Edgerton, Jr., Bryn Mawr; Lynn L. Copeland, Coatesville, both of Pa.

[73] Assignee: C. Willis Edgerton, Jr., Bryn Mawr, Pa.

[22] Filed: Apr. 21, 1976

[21] Appl. No.: 678,913

[52] U.S. Cl. ..... 190/48; 150/3; 150/7

[51] Int. Cl.[2] ..... A45C 5/08

[58] Field of Search ..... 190/43, 48; 150/3, 7

[56] References Cited

UNITED STATES PATENTS

| | | | |
|---|---|---|---|
| 188,673 | 3/1877 | Redden | 150/7 |
| 2,029,466 | 2/1936 | Damm | 190/48 |
| 2,271,211 | 1/1942 | Stockton | 150/3 UX |
| 2,273,128 | 2/1942 | Madsen | 150/3 X |
| 2,338,279 | 1/1944 | Blake | 150/7 |
| 3,655,118 | 4/1972 | Rinecker | 150/3 X |

FOREIGN PATENTS OR APPLICATIONS

| | | | |
|---|---|---|---|
| 728,856 | 4/1955 | United Kingdom | 190/43 |

*Primary Examiner*—Donald F. Norton

*Attorney, Agent, or Firm*—Dorfman, Herrell and Skillman

[57] ABSTRACT

A storage container adapted, when empty, to be collapsed and folded upon itself for compact storage. The container is composed of a flexible waterproof material having an elongated opening therein. The opening of the container is rendered substantially waterproof by a waterproof tubular portal element which is open at both ends. One end of the element surrounds the container opening and is sealed to the wall of the container, so that access to and from the container is obtained only through the tubular portal element. The opening is sealed by flattening the tubular element and rolling it upon itself substantially parallel to the longitudinal dimension of the opening. Fastening strips are provided to extend along the opposite sides of the longitudinal opening to provide a mechanical closure. In addition, cover flap means is provided to enclose the rolled-up tubular portal to maintain the opening closed, in the preferred embodiment, the flaps having fastening strips extending along the full length of the opening.

3 Claims, 4 Drawing Figures

WATERPROOF CONTAINER FOR GOODS

The present invention provides a portable storage unit which may be collapsed and folded when not in use. The unit is watertight and is preferably also airtight so as to avoid damage to the material stored in the unit by moisture either in liquid form or in vapor form.

Flexible storage units have been available for many years. In particular, a duffle bag is the standard equipment used by sailors in their travels. The standard duffle bag is composed of a tightly woven canvas which is water-resistant, although not waterproof. The water-resistant fabric of the conventional duffle bag sheds water and if the duffle bag is tightly closed, the duffle bag may be exposed to the weather without soaking the contents. However, if the conventional duffle bag sits in water, for example in puddles or in bilge water for a prolonged period, the water migrates into the interior and dampens the contents. Furthermore, if the duffle bag is stored in a humid atmosphere, the atmosphere penetrates the contents of the duffle bag and the contents tend to become damp.

If allowed to stand for any prolonged period, dampness in the interior of the duffle bag tends to cause mildew or mold which is virtually impossible to eliminate once it is established within fabrics or other personal effects which might be stored in the duffle bag.

Efforts to overcome the adverse characteristics of the standard duffle bag have included moisture-proofing the fabric. However, there has been no satisfactory way to treat the closure of the duffle bag to provide a moisture barrier against the infusion of water in liquid or vapor form. Where a moisture-proof storage unit has been required, it has been necessary to utilize a rigid-walled structure, or a separate waterproof envelope for the container.

The present invention provides an improved container for storing goods which is not only water-resistant but is substantially waterproof and yet which may be readily folded into a compact package for storage when not used and may be opened widely to provide for the introduction and removal of goods from the container.

More particularly, the present invention provides a flexible-walled container composed of a waterproof fabric having an opening which is provided with a watertight closure which is of simple form, yet which is fully effective in operation and use.

A preferred embodiment of the present invention comprises a closure portal in the form of a tubular element which, when opened, provides a wide passageway for the introduction and removal of goods into and from the device and which may be closed by flattening the element and rolling the flattened tubular element upon itself to seal the closure.

The preferred embodiment also includes retaining means which operates to maintain the tubular element flattened when the container is sealed and additional retaining means for keeping the tubular element rolled-up upon itself.

The invention also provides a waterproof container which is impermeable to air having an airtight closure which is effective to prevent both infusion of air and moisture into the container, for example during handling, and also exhaust of air through the closure, for example when the container is subjected to compressive loads tending to increase the air pressure within the container.

The specific objects of the invention are more fully set forth hereinafter with reference to the accompanying drawing, wherein.

Figure 3:
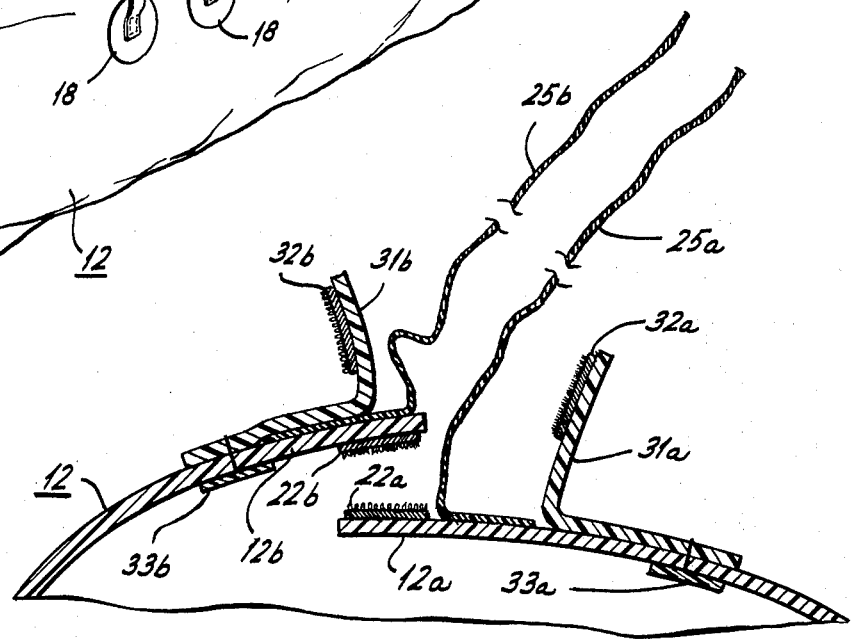
Figure 4:
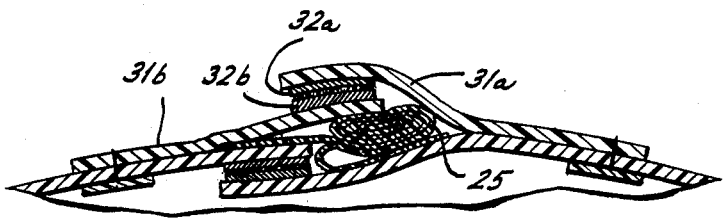

FIG.. 3 is a local transverse sectional view at an enlarged scale showing the closure of the container in an open condition; and FIG. 4 is a view similar to FIG. 3 showing the closure in a closed condition.

Figure 1:
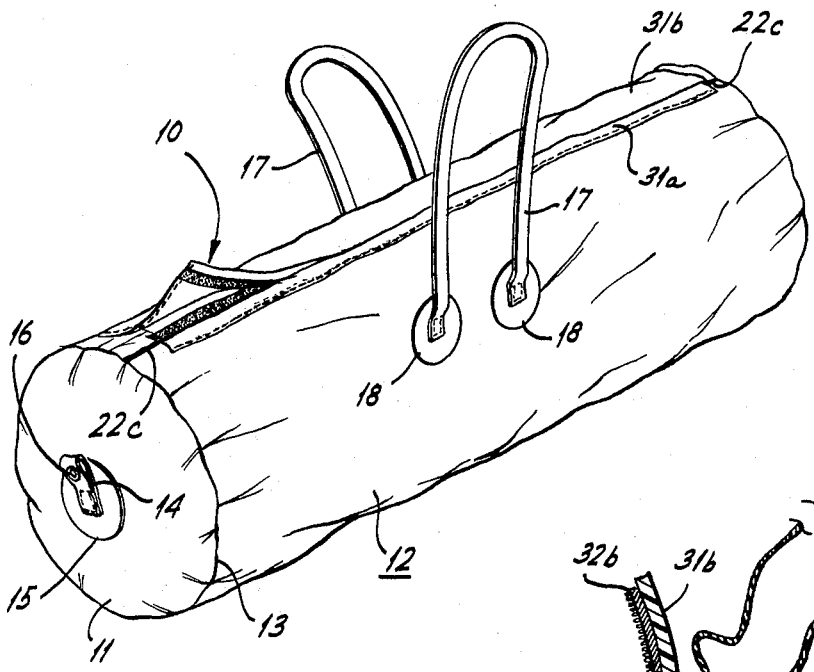
FIG. 1 is a perspective view of a container made in accordance with the invention.

Referring now to the drawing, the container of the present invention comprises a flexible material which is formed into a generally cylindrical shape having circular end walls, as indicated at 11, and a generally cylindrical side wall 12. The container has an access opening in the side wall which is secured by a closure indicate at 10 in FIG. 1. In the present instance, the material of the container is a neoprene-coated, nylon fabric which is sufficiently flexible to permit folding of the material upon itself. In the present instance, the end walls 11 of the container are separate pieces which are connected to the side wall 12 by conventional sewn-and-taped seams, as indicated at 13. End tabs are provided in the end wall 11, as indicated at 14, the end tab being secured by a reinforcing patch 15 cemented to the end wall 11. The end tab 14 is provided with a grommet 16 to permit the container to be easily tied down and to facilitate attachment of other items to the container. Carrying handles 17 are provided on opposite sides of the closure 10. Like the end tabs, the handles are attached to the side wall 12 by patches 18 which are cemented to the material of the side wall. It is noted that the length of the handles 17 permits the bights of the handle loops to meet above the closure 10, permitting carrying of the container by a single hand and also to permit storage of additional articles exteriorly of the container between the two handles. For example, fishing rods, tent poles, and other camping equipment may be carried without inserting them into the interior of the container.

The cylindrical side wall of the container extends from one side of the closure 10 continuously to the other side of the closure. As shown in FIGS. 3 and 4, the side wall edge portions **12*a* and 12*b* are intended to be releasably interconnected, in the present instance in overlapping relationship. To effect the releasable attachment of the edges 12*a* and 12*b*, the underlapped edge 12*a* has along its outer surface a fastener strip 22*a* and the overlapped edge 12*b* is provided with a complementary fastener strip 22*b*. The fastener strips 22*a* and 22*b* are adapted to releasably interengage with one another to firmly interconnect the edges 12*a* and 12*b*, while providing easy release of these edges to produce an opening into the interior of the cylindrical side wall 12. At the ends of the opening provided by disengaging the fasteners 22*a* and 22*b*, the edges 12*a* and 12*b* are overlapped and permanently secured together, as indicated at 22*c* in FIG. 1, for example by a sewn-and-sealed seam which is both airtight and watertight. Between the sealed ends at 22*c*, the overlapped edge portions 12*a* and 12*b* may be separated to provide a wide access opening into the interior of the container, the flexible nature of the material of the side wall 12 permitting ready manipulation of the edges 12*a* and 12*b*** to permit such access.

In the present instance, the fastener strips 12*a* and 12*b* are of the hook-and-loop type which is available at the present time under the trademark "VELCRO" and is disclosed in several U.S. patents as consisting of a synthetic material sold in ribbon, sheet or piece goods form, said material having complemental parts which adhere to each other when pressed together and adapted for use as a closure, fastener or button for closing garments, curtains, or the like. Fastener strips of this character are composed of soft flexible material which avoids damaging the material of the container or the goods which are inserted or withdrawn through the opening between the edges 12*a* and 12*b*. The flexible nature of the fastener strips permits the spreading of the edges 12*a* and 12*b* to the maximum extent to permit ready insertion of goods through the opening.

Figure 2:
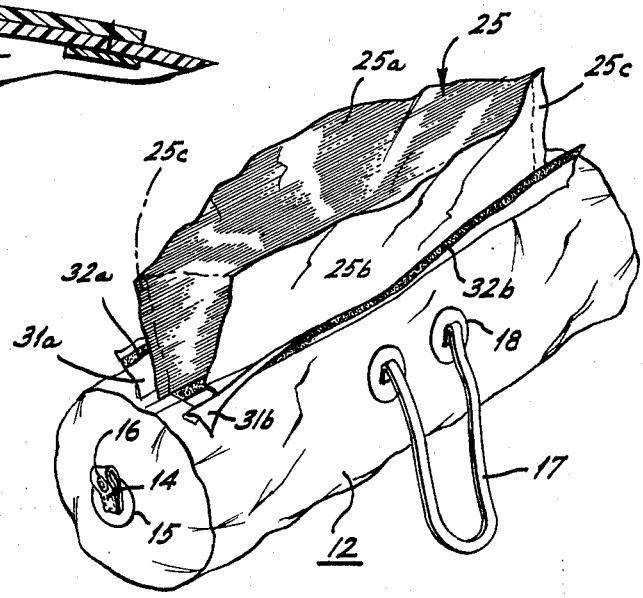
FIG. 2 is a view similar to FIG. 1 at a slightly reduced scale showing the container in open condition.

The opening between the edges 12*a* and 12*b* is sealed by mounting an elongated open-ended tubular portal element 25 surrounding the opening. In the present instance, the tubular portal element 25 comprises a pair of thin sheets of plasticized material 25*a* and 25*b* (see FIG. 2) disposed in face-to-face relationship and sealed together along the edges, as indicated at 25*c*, to form the tubular open-ended portal element. The tubular portal element 25 has its inner end opening cemented about the perimeter of the opening in the side wall 12 formed between the edges 12*a* and 12*b*. In the present instance, the material of the tubular portal element 25 is of a character to enable secure attachment around the opening by a simple cementing operation, the adhesive bond between the plasticized sheet material of the portal element 25 and the material of the side wall 12 being both airtight and watertight. When cemented in this fashion about the opening, the only access into the interior of the container is through the tubular portal 25. The plasticized material of the portal 25 is a thin, flexible material which, in conjunction with the flexible nature of the material in the side wall 12 and the fastener strips 22*a* and 22*b*, permits the opening to be manipulated to accommodate goods in a wide variety of shapes for insertion through the portal.

It should be noted that the width of the flattened tubular portal corresponds to the length of the opening between the edges 12*a* and 12*b*, and when the portal is opened out to form a circular passage for the contents, the diameter is approximately two-thirds of the width of the flattened portal. Thus, if the length of the cylindrical portion of the container is 24 inches, after allowing for the end closures 22*c* and the marginal connections 25*c*, the portal may be opened to a diameter of approximately 14 inches. The 24-inch length of the fabric making up the side wall 12 is also an appropriate length for the handles 17 where the mounting patches 18 are spaced apart by a distance of approximately 4 to 6 inches.

In order to seal the opening to the container after the container has been filled with the goods to be stored therein, the opening is mechanically closed by engaging the complementary fastener strips 22*a* and 22*b*. Engagement of the strips 22*a* and 22*b* provides a resistance against separation of the overlapped edges 12*a* and 12*b* except by a peeling action in which the separating force is applied substantially perpendicular to the plane of the overlapped edge portions 12*a* and 12*b*. With the fastener strips 22*a* and 22*b* engaged, the tubular portal 25 is flattened so that the opposite sheets 25*a* and 25*b* are disposed in flush confronting relation. The portal may then be rolled-up upon itself, as shown in FIG. 4, to provide a tight barrier against entry or exit of moisture or air through the tubular portal 25. The tubular portal 25, when rolled up upon itself as shown in FIG. 4, lies neatly along the overlapped edges 12*a* and 12*b* of the side wall 12.

The opening may then be securely closed by enclosing the rolled-up portal 25. To this end, cover flaps 31*a* and 31*b* are secured to the side wall 12 so as to overlie the edge portions 12*a* and 12*b*, respectively. In the present instance, the flaps are sewn and sealed to the side wall by stitching and a cover strip, as shown at 33*a* and 33*b*, extending along the length of the container opening. The free edges of the flaps 31*a* and 31*b* are adapted to be overlapped, as shown in FIG. 4, and to be releasably fastened in the overlapping relationship by fastener strips 32*a* and 32*b* which are of the hook-and-loop type similar to the strips 22*a* and 22*b*. The fastener strips 32*a* and 32*b* also extend along the full length of the opening to provide complementary releasable fasteners which maintain the flaps 31*a* and 31*b* in overlapping relationship enclosing the rolled-up portal 25, as shown in FIG. 4.

When closed and sealed in this manner, the container has been found to be substantially waterproof. A filled container was immersed in a body of water and when removed from the water and opened, the contents within the container were still dry. When the container was filled with compressible material and closed, and then subjected to compressive forces, the compressive forces did not break the seal provided by the rolled-up tubular portal and no air was expelled from the container. Thus, the closure 10 provided by the sealed opening is believe to be secure against the infusion of moisture, either in liquid form or in vapor form, allowing the container to be used to maintain the contents dry under even the most adverse condition.

The flexible nature of the materials making up the container enables the container to be collapsed and folded flat when not in use. Furthermore, when the container is only partially filled, the walls may be collapsed so that the partially filled container will occupy a space smaller than the space occupied by a completely filled container. If it is desired to provide rigid side walls to protect the contents of the container, the rigidity may be imparted to the container by insertion of a framework therein, which may be designed to accommodate the particular goods which are to be packed into the container. The container is manufactured using standard manufacturing techniques for providing sealed seams and the containers therefore are susceptible to highly economic manufacture and assembly.

While a particular embodiment of the invention has been herein illustrated and described, it is not intended to limit the invention to such disclosure, but changes and modifications may be made therein and thereto within the scope of the following claims.

I claim:

1. A watertight container having wall means of a flexible material, at least one of said wall means having a pair of complementary edge portions confronting one another to provide an opening into the interior of said container, complementary fastening strips extending along said edges and operable to releasably engage each other to provide a releasable mechanical closure for said opening, a flexible tubular portal having opposite ends thereof open, to provide a passageway therethrough, one of said open ends mounted on said side wall means in surrounding relation to said opening and sealed to said side wall means so as to provide a tubular passageway for inserting and removing goods from said container through said opening, said tubular portal operable to be flattened and rolled upon itself to provide a roll of said flexible material along the length of said confronting edges, flap means mounted on said side wall means parallel to said confronting edges, cooperating fastening strips extending along the length of said edges on said flap means and said fastening strips being adapted to be releasably engaged with one another to enclose the rolled-up portal and retain the same in its flattened rolled-up condition to thereby seal the opening in said container against passage of moisture therethrough in either liquid or gaseous form.

2. A container according to claim 1 wherein said portal comprises a pair of confronting sheets of flexible material which are sealed together in face-to-face confronting relation and along the marginal edges thereof to provide a tubular portal which is capable of being flattened into intimate face-to-face contact throughout its entire width to thereby facilitate rolling up of said portal material upon itself when it is in a flattened condition.

3. A container according to claim 1 wherein said complementary fastening strips comprise hook-and-loop fastener strips extending continuously along the free edges of said side wall means to constitute said mechanical closure for said container and additional hook-and-look fastener strips extending along the free edges of said flap means to enclose said rolled-up portal element.

* * * * *